US009348352B2

(12) United States Patent
Lin

(10) Patent No.: US 9,348,352 B2
(45) Date of Patent: May 24, 2016

(54) BANDGAP REFERENCE CIRCUIT

(71) Applicant: uPI Semiconductor Corp., Hsinchu County (TW)

(72) Inventor: Wen-Sheng Lin, Hsinchu County (TW)

(73) Assignee: uPI Semiconductor Corp., Hsinchu County (TW)

( * ) Notice: Subject to any disclaimer, the term of this patent is extended or adjusted under 35 U.S.C. 154(b) by 154 days.

(21) Appl. No.: 14/164,259

(22) Filed: Jan. 27, 2014

(65) Prior Publication Data

US 2014/0340068 A1 Nov. 20, 2014

(30) Foreign Application Priority Data

May 17, 2013 (TW) ..... 102117582 A

(51) Int. Cl.

| | |
|---|---|
| ***G05F 3/08*** | (2006.01) |
| ***G05F 3/26*** | (2006.01) |
| ***G05F 3/20*** | (2006.01) |
| ***G05F 3/30*** | (2006.01) |

(52) U.S. Cl.

CPC .. *G05F 3/08* (2013.01); *G05F 3/20* (2013.01); *G05F 3/26* (2013.01); *G05F 3/30* (2013.01)

(58) Field of Classification Search

CPC ..... G05F 3/08
USPC ..... 323/313, 314, 315, 316; 327/539, 512, 327/347, 349
See application file for complete search history.

(56) References Cited

U.S. PATENT DOCUMENTS

| | | | | |
|---|---|---|---|---|
| 5,867,013 | A | 2/1999 | Yu | |
| 7,531,999 | B2 | 5/2009 | Chang | |
| 2006/0181336 | A1 | 8/2006 | Lee et al. | |
| 2008/0150594 | A1 | 6/2008 | Taylor et al. | |
| 2011/0025291 | A1* | 2/2011 | Lee et al. | 323/313 |

FOREIGN PATENT DOCUMENTS

| | | |
|---|---|---|
| CN | 1725137 | 1/2006 |
| EP | 1852766 | 11/2010 |
| TW | 200717213 | 5/2007 |

OTHER PUBLICATIONS

"Office Action of Taiwan Counterpart Application", issued on Feb. 5, 2015, p. 1-p. 4.

* cited by examiner

*Primary Examiner* — Jeffrey Gblende
*Assistant Examiner* — Trinh Dang
(74) *Attorney, Agent, or Firm* — Jianq Chyun IP Office

(57) ABSTRACT

A bandgap reference circuit is provided and which includes an operating voltage, a current mirror, a first p-channel metal-oxide semiconductor (PMOS) transistor and an amplifier. The current mirror is coupled to the operating voltage. The first PMOS transistor is coupled to the operating voltage and the current mirror. The amplifier is coupled to the current mirror and the first PMOS transistor. When the bandgap reference circuit is activated, the operating voltage starts to supply voltage such that the first PMOS transistor is turned on first. When the operating voltage is higher than a preset voltage level, the first PMOS transistor is turned off, in order to complete an start-up process.

12 Claims, 4 Drawing Sheets

BANDGAP REFERENCE CIRCUIT

CROSS-REFERENCE TO RELATED APPLICATION

This application claims the priority benefit of Taiwan application serial no. 102117582, filed on May 17, 2013. The entirety of the above-mentioned patent application is hereby incorporated by reference herein and made a part of this specification.

BACKGROUND OF THE INVENTION

1. Field of the Invention

The invention relates to an integrated circuit design, and more particularly, to a bandgap reference circuit.

2. Description of Related Art

FIG. 1 is a schematic diagram illustrating a circuit structure for a conventional bandgap reference voltage. A bandgap reference circuit 10 is configured to generate a bandgap reference voltage Vbg. However, the bandgap reference circuit 10 is only operable with collocation of a level detector 20 and a start-up path circuit 30. This is because an amplifier 12 in the bandgap reference circuit 10 requires a specific bias voltage in order to complete a start-up process. Generally, a bias circuit includes the level detector 20 and the start-up path circuit 30. With application requirements, sometimes it requires other circuits for achieving the bias voltage in order to complete the start-up process. The bandgap reference circuit 10 may not complete the start-up process if a path in a specific circuit of the bias circuit does not operate normally. For example, if a switch TG in the start-up path circuit 30 is poorly designed, it usually results in an incomplete start-up process.

In addition, the conventional bandgap reference circuit 10 requires additional bias circuit, thus it may additionally consume more power while increasing overall circuit area. Beside, since circuitry of the bias circuit is complicated, a problem in defective rate may be derived during massive production.

SUMMARY OF THE INVENTION

Accordingly, the invention is directed to a bandgap reference circuit configured to complete a start-up process without specific bias circuit required, and overcome the problem of the incomplete start-up process in conventional art.

The invention proposes a bandgap reference circuit including an operating voltage, a current mirror, a first PMOS transistor and an amplifier. The current mirror is coupled to the operating voltage. The first PMOS transistor is coupled to the operating voltage and the current mirror. The amplifier is coupled to the current mirror and the first PMOS transistor. When the bandgap reference circuit is activated, the operating voltage starts to supply voltage such that the first PMOS transistor is turned on first, and when the operating voltage is higher than a preset voltage level, the first PMOS transistor is then turned off, in order to complete a start-up process.

In an embodiment of the invention, after the first PMOS transistor is turned on, transistors of the current mirror are also turned on.

In an embodiment of the invention, after the first PMOS transistor is turned off, the transistors of the current mirror remain turned on.

In an embodiment of the invention, the current mirror includes a second PMOS transistor and a third PMOS transistor. A gate of the second PMOS transistor is coupled to a source of the first PMOS transistor. A source of the second PMOS transistor is coupled to the operating voltage and a gate of the first PMOS transistor. A gate of the third PMOS transistor is coupled to the gate of the second PMOS transistor and the source of the first PMOS transistor. A source of the third PMOS transistor is coupled to the operating voltage and the gate of the first PMOS transistor.

In an embodiment of the invention, after the first PMOS transistor is turned on, with increase in a value of the operating voltage, the second PMOS transistor is also turned on.

In an embodiment of the invention, when the first PMOS transistor is turned off with increase in the value of the operating voltage, the second PMOS transistor is turned on.

In an embodiment of the invention, the bandgap reference circuit further includes a fourth PMOS transistor. A gate of the fourth PMOS transistor is coupled to the operating voltage. A source of the fourth PMOS transistor is coupled to the gate of the second PMOS transistor, the gate of the third PMOS transistor and the output terminal of the amplifier. A drain of the fourth PMOS transistor is coupled to the drain of the third PMOS transistor.

In an embodiment of the invention, when the operating voltage starts to supply voltage, the fourth PMOS transistor is turned on first than the third PMOS transistor.

In an embodiment of the invention, when a voltage difference between the operating voltage and the output terminal of the amplifier is higher than a preset voltage level, the fourth PMOS transistor is then turned off.

In an embodiment of the invention, when the bandgap reference circuit is in a steady state, a bandgap reference voltage is provided at a drain of the third PMOS transistor.

In an embodiment of the invention, the bandgap reference circuit further includes a first resistor and a second resistor. The first resistor has a first terminal coupled to the drain of the first PMOS transistor and the drain of the second PMOS transistor. The second resistor has a first terminal coupled to the drain of the third PMOS transistor.

In an embodiment of the invention, the bandgap reference circuit further includes a first PNP bipolar transistor, a third resistor and a second PNP bipolar transistor. An emitter of the first PNP bipolar transistor is coupled to a second terminal of the first resistor. A collector and a base of the first PNP bipolar transistor are coupled to a ground terminal. A first terminal of the third resistor is coupled to a second terminal of the second resistor. An emitter of the second PNP bipolar transistor is coupled to a second terminal of the third resistor. A collector and a base of the second PNP bipolar transistor are coupled to the ground terminal.

In an embodiment of the invention, the preset voltage level is a threshold voltage of the first PMOS transistor in a cut-off state.

Based on above, when the bandgap reference circuit of the invention performs the start-up process, no additional bias circuit is required owing to element characteristics of PMOS transistor, such that power consumption of the conventional bias circuit can be avoided and the circuit area can also be reduced. On the other hand, in comparison with traditional methods, a simpler circuit structure is adopted, thus it is easier to configure adjustment parameters for circuits in manufacturing process, so as to improve production yield rate. In addition, the circuit area being used is relatively smaller, so as to lower manufacturing costs.

However, the above descriptions and the below embodiments are only used for explanation, and they do not limit the scope of the present invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
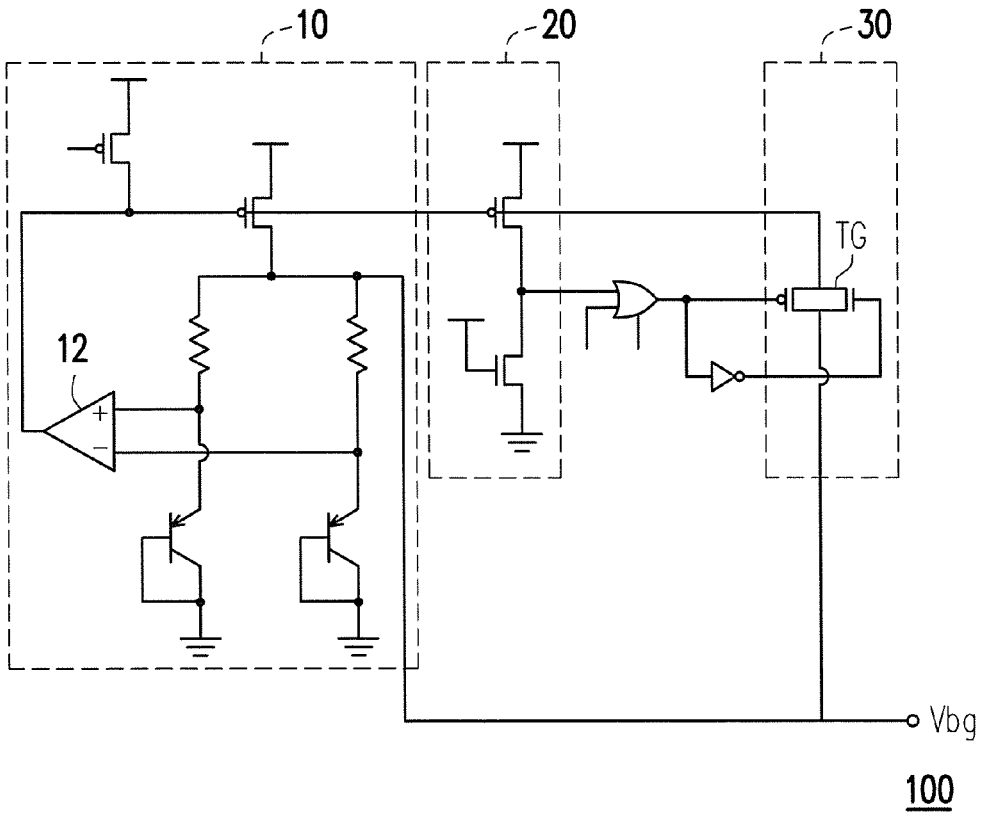
FIG. 1 (PRIOR ART)
FIG. 1 is a schematic diagram illustrating a circuit structure for a conventional bandgap reference voltage.

Reference will now be made in detail to the exemplary embodiments of the invention, examples of which are illustrated in the accompanying drawings. Moreover, elements/components with the same or similar reference numerals represent the same or similar parts in the drawings and embodiments.

In the following embodiments, when "A" device is referred to be "connected" or "coupled" to "B" device, the "A" device can be directly connected or coupled to the "B" device, or other devices probably exist there between. The term "circuit" represents at least one component or a plurality of components, or at least one component or a plurality of components actively and/or passively coupled to each other to provide suitable functions. The term "signal" represents at least one current, voltage, load, temperature, data or other signal.

Figure 2:
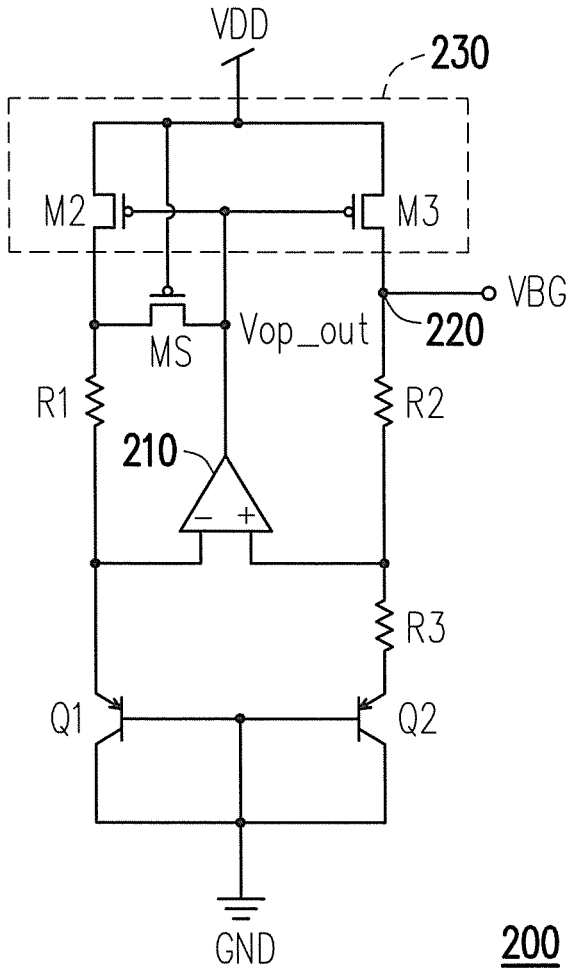
FIG. 2 is a schematic diagram of a bandgap reference circuit according to an embodiment of the invention.

FIG. 2 is a schematic diagram of a bandgap reference circuit according to an embodiment of the invention. Referring to FIG. 2, a bandgap reference circuit 200 includes an operating voltage VDD, a current mirror 230, a first p-channel metal-oxide semiconductor (PMOS) transistor MS and an amplifier 210. The current mirror 230 can be formed by disposing a plurality of transistors. The amplifier 210 is coupled to the current mirror 230 and the first PMOS transistor MS. When the bandgap reference circuit 200 is activated, the operating voltage VDD starts to supply voltage such that the first PMOS transistor MS is turned on first, and when the operating voltage VDD is higher than a preset voltage level, the first PMOS transistor MS is then turned off, in order to complete a start-up process.

It should be noted that, after the first PMOS transistor MS is turned on, the transistors of the current mirror 230 are also turned on; and after the first PMOS transistor MS is turned off, the transistors of the current mirror 230 remain turned on.

Further details are illustrated below. The bandgap reference circuit 200 further includes a first resistor R1 and a second resistor R2. The current mirror 230 includes a second PMOS transistor M2 and a third PMOS transistor M3. A source of the second PMOS transistor M2, a source of the third PMOS transistor M3 and a gate of the first PMOS transistor MS are all coupled to the operating voltage VDD. The gate of the third PMOS transistor M3 is coupled to a gate of the second PMOS transistor M2, an output terminal of the amplifier 210 and a source of the first PMOS transistor MS. A drain of the first PMOS transistor MS is coupled to a drain of the second PMOS transistor M2 and a first terminal of the first resistor R1. The second resistor R2 has a first terminal coupled to a drain of the third PMOS transistor M3. An inverse input terminal of the amplifier 210 is coupled to a second terminal of the first resistor R1. A non-inverse input terminal of the amplifier 210 is coupled to a second terminal of the second resistor R2.

After the first PMOS transistor MS is turned on, with increase in a value of the operating voltage VDD, the second PMOS transistor M2 is also turned on. Next, when the first PMOS transistor MS is turned off with increase in the value of the operating voltage, the second PMOS transistor M2 is turned on.

In addition, the bandgap reference circuit 200 may further include a first PNP bipolar transistor Q1, a third resistor R3 and a second PNP bipolar transistor Q2. An emitter of the first PNP bipolar transistor Q1 is coupled to the second terminal of the first resistor R1. A collector and a base of the first PNP bipolar transistor Q1 are coupled to a ground terminal GND. A first terminal of the third resistor R3 is coupled to the second terminal of the second resistor R2. An emitter of the second PNP bipolar transistor Q2 is coupled to a second terminal of the third resistor R3. A collector and a base of the second PNP bipolar transistor Q2 are coupled to the ground terminal GND.

Figure 3:
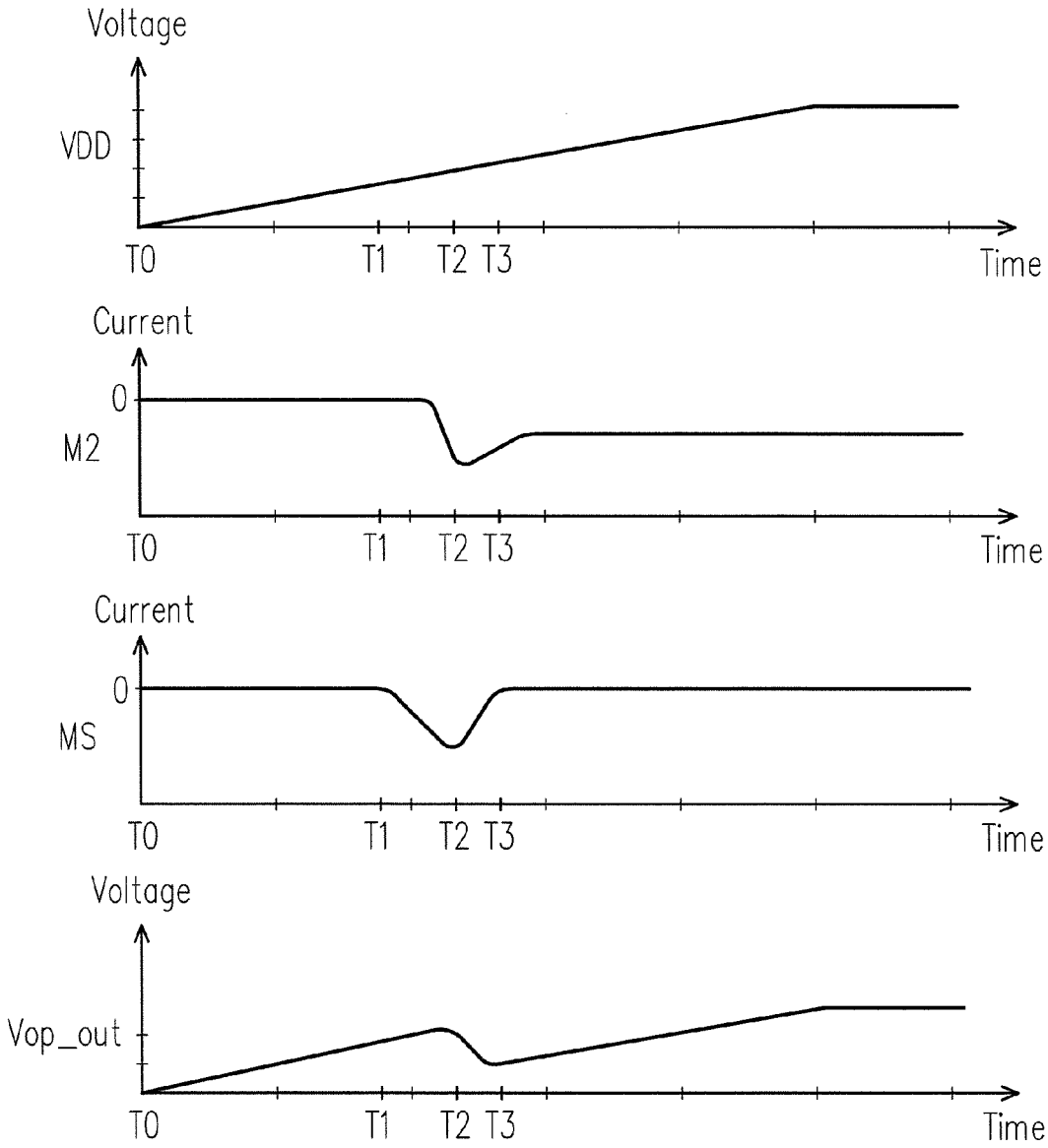
FIG. 3 is a waveform schematic diagram of the bandgap reference circuit 200.

FIG. 3 is a waveform schematic diagram of the bandgap reference circuit 200. Please refer to FIG. 2 and FIG. 3 together. During the start-up process of the bandgap reference circuit 200, when the operating voltage VDD starts to supply voltage at a time point T0, the value of the operating VDD starts to rise from 0. The first PMOS transistor MS is first turned on at a time point T1, and a voltage value of a first (inverse) input terminal coupled to the amplifier 210 will rise. Next, the second PMOS transistor M2 is turned on at a time point T2 so a path from the second PMOS transistor M2 to the first PNP bipolar transistor Q1 is in a current state, such that the third PMOS transistor M3 in the current mirror is also turned on, and a path from the third PMOS transistor M3 to the second PNP bipolar transistor Q2 is also in the current state.

When the operating voltage VDD is higher than a preset voltage level at a time point T3, the first PMOS transistor MS is turned off. In addition, the preset voltage level may be a threshold voltage of the first PMOS transistor MS in a cut-off state. At this time (the time point T3), the start-up process of the bandgap reference circuit 200 is completed. When the bandgap reference circuit 200 is in a steady state, the amplifier 210 may continue to detect a voltage difference between the first input terminal and a second input terminal, and a bandgap reference voltage VBG can be provided at the drain of the third PMOS transistor M3.

It should be noted that, with assistance of the first PMOS transistor MS, the bandgap reference circuit 200 may start to provide current. The first PMOS transistor MS being turned off at the time point T3 can avoid a non zero starting current generated by the first PMOS transistor MS from affecting voltage stability at a terminal 220.

During operation of the bandgap reference circuit 200, a voltage between the first input terminal and the second input terminal of the amplifier 210 is also changed. The amplifier 210 may constantly detect the voltage difference between two input terminals, and provide a control signal Vop_out to the gate of the second PMOS transistor M2 and the gate of the third PMOS transistor M3, and thereby controls the current mirror 230 to adjust current flowing through the path from the second PMOS transistor M2 to the first PNP bipolar transistor Q1, adjust current flowing through the path from the third PMOS transistor M3 to the second PNP bipolar transistor Q2, and stabilize the bandgap reference voltage VBG at the terminal 220 by a negative feedback.

It should be noted that, in the embodiment of the invention, since it does not require bias circuit to be used additionally as in conventional art in order to complete the start-up process, the problem of the incomplete start-up can be solved. On the other hand, according to the embodiment of the invention, power consumption of the conventional bias circuit can be avoided and usage of the circuit area can also be reduced. Moreover, in comparison with traditional methods, circuit structure being used is relatively simpler.

Figure 4:
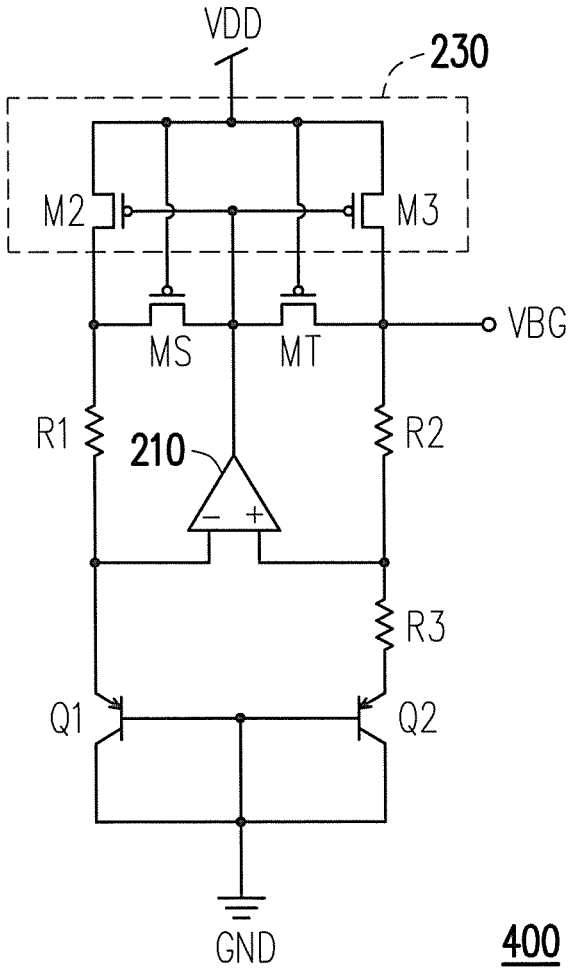
FIG. 4 is a schematic diagram of a bandgap reference circuit according to another embodiment of the invention.

FIG. 4 is a schematic diagram of a bandgap reference circuit according to another embodiment of the invention. Referring to FIG. 4, a structure of a bandgap reference circuit 400 is almost identical to the bandgap reference circuit 200. A difference between the two bandgap reference circuits is that, the bandgap reference circuit 400 further includes a fourth PMOS transistor MT in which the fourth PMOS transistor MT and the first PMOS transistor MS are symmetrically disposed. A gate of the fourth PMOS transistor MT is coupled to the operating voltage VDD. A source of the fourth PMOS transistor MT is coupled to the gate of the second PMOS transistor M2, the gate of the third PMOS transistor M3 and the output terminal of the amplifier 210. A drain of the fourth PMOS transistor MT is coupled to the drain of the third PMOS transistor M3.

When the operating voltage VDD starts to supply voltage, the fourth PMOS transistor MT is turned on first than the third PMOS transistor M3. When the operating voltage VDD is higher than a preset voltage level, the fourth PMOS transistor MT is then turned off.

In addition, the first PMOS transistor MS and the fourth PMOS transistor MT may be of the same structure, such that the preset voltage level can be a threshold voltage of the first PMOS transistor MS/the fourth PMOS transistor MT in a cut-off state.

It should be noted that, by disposing the fourth PMOS transistor MT, it can increase a speed for turning on the third PMOS transistor M3 in the current mirror 230.

In light of above, when the bandgap reference circuit according to the embodiments of the invention performs the start-up process, no additional bias circuit is required owing to element characteristics of PMOS transistor, such that power consumption of the conventional bias circuit can be avoided and the circuit area can also be reduced. On the other hand, in comparison with traditional methods, a simpler circuit structure is adopted, thus it is easier to configure adjustment parameters for circuits in manufacturing process, so as to improve production yield rate. In addition, the circuit area being used in the embodiments of the invention is relatively smaller, so as to lower manufacturing costs.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

Any of the embodiments or any of the claims of the invention does not need to achieve all of the objects, advantages or features disclosed by the invention. Moreover, the abstract and the headings are merely used to aid in searches of patent files and are not intended to limit the scope of the claims of the present invention.

What is claimed is:

1. A bandgap reference circuit, comprising:

an operating voltage;

a current mirror coupled to the operating voltage, wherein the current mirror comprises:

a second PMOS transistor having a gate coupled to a source of the first PMOS transistor, and a source coupled to the operating voltage and a gate of the first PMOS transistor; and a third PMOS transistor having a gate coupled to the gate of the second PMOS transistor and the source of the first PMOS transistor and a source coupled to the operating voltage and the gate of the first PMOS transistor;

a first PMOS transistor coupled to the operating voltage and the current mirror; and an amplifier coupled to the current mirror and the first PMOS transistor, wherein when the bandgap reference circuit is activated, the operating voltage is supplied such that the first PMOS transistor is turned on first, and when the operating voltage is higher than a preset voltage level, the first PMOS transistor is then turned off, in order to complete an start-up process.

2. The bandgap reference circuit of claim 1, wherein after the first PMOS transistor is turned on, a plurality of transistors of the current mirror are also turned on.

3. The bandgap reference circuit of claim 1, wherein after the first PMOS transistor is turned off, a plurality of transistors of the current mirror remain turned on.

4. The bandgap reference circuit of claim 1, wherein after the first PMOS is turned on, with increase in a value of the operating voltage, the second PMOS transistor is also turned on.

5. The bandgap reference circuit of claim 1, wherein when the first PMOS transistor is turned off with increase in a value of the operating voltage, the second PMOS transistor is turned on.

6. The bandgap reference circuit of claim 1, further comprising:

a fourth PMOS transistor having a gate coupled to the operating voltage, a source coupled to the gate of the second PMOS transistor, the gate of the third PMOS transistor and an output terminal of the amplifier, and a drain coupled to a drain of the third PMOS transistor.

7. The bandgap reference circuit of claim 1, wherein when the bandgap reference circuit is in a steady state, a bandgap reference voltage is provided at a drain of the third PMOS transistor.

8. The bandgap reference circuit of claim 1, further comprising:

a first resistor having a first terminal coupled to a drain of the first PMOS transistor and a drain of the second PMOS transistor; and a second resistor having a first terminal coupled to a drain of the third PMOS transistor.

9. The bandgap reference circuit of claim 1, wherein the preset voltage level is a threshold voltage of the first PMOS transistor in a cut-off state.

10. The bandgap reference circuit of claim 6, wherein when the operating voltage is supplied, the fourth PMOS transistor is turned on first than the third PMOS transistor.

11. The bandgap reference circuit of claim 6, wherein when the operating voltage is higher than the preset voltage level, the fourth PMOS transistor is turned off.

12. The bandgap reference circuit of claim 8, further comprising:

a first PNP bipolar transistor having an emitter coupled to a second terminal of the first resistor, a collector and a base both coupled to a ground terminal;

a third resistor having a first terminal coupled to a second terminal of the second resistor; and a second PNP bipolar transistor having an emitter coupled to a second terminal of the third resistor, a collector and a base both coupled to the ground terminal.

* * * * *